United States Patent [19]

Onose et al.

[11] Patent Number: 5,008,716

[45] Date of Patent: Apr. 16, 1991

[54] PAPER COOLING APPARATUS FOR AN ELECTROPHOTOGRAPHIC PRINTER

[75] Inventors: Tsukasa Onose; Yasuo Kikuchi; Toshitaka Ogawa; Minoru Seino, all of Ibaraki, Japan

[73] Assignee: Hitachi Koki Co., Ltd., Tokyo, Japan

[21] Appl. No.: 417,621

[22] Filed: Oct. 5, 1989

[51] Int. Cl.[5] ..... G03G 21/00

[52] U.S. Cl. ..... 355/322; 270/39; 355/30; 355/308

[58] Field of Search ..... 355/308, 309, 322, 282, 355/291, 30; 34/18, 23; 226/97; 271/211, 216, 217, 309; 493/408, 438, 439, 450; 270/39

[56] References Cited

U.S. PATENT DOCUMENTS 4,036,087 7/1977 Braun ..... 271/211 X
4,460,350 7/1984 Mittal et al. ..... 493/450 X

FOREIGN PATENT DOCUMENTS 0044421 3/1980 Japan ..... 493/418
0067857 6/1981 Japan ..... 355/291

*Primary Examiner*—Fred L. Braun
*Assistant Examiner*—J. E. Barlow, Jr.
*Attorney, Agent, or Firm*—Michael L. Keller

[57] ABSTRACT

An electrophotographic printer in which toner is printed and fused and the paper thereafter folded and stacked. To avoid toner stick a blower blows cooling air between adjacent folded sheets. The blower may be mounted on a horizotnally slidable paper guide. The stacker table may be lowered so that the top of the stack is maintained at the same height or the blower may be moved vertically in response to the output of a sensor detecting the top of the folded stack.

5 Claims, 3 Drawing Sheets

PAPER COOLING APPARATUS FOR AN ELECTROPHOTOGRAPHIC PRINTER

BACKGROUND OF THE INVENTION

1. Field of the Invention

The present invention relates to a cooling apparatus for cooling printing paper after fixing in a thermal fixing type printer, and particularly relates to a paper cooling apparatus in an electrophotographic printer.

2. Description of the Prior Art

In an electrophotographic printer, the printing paper is commonly heated in a thermal fixing process so that toner adhering to the paper is fused and fixed thereon forming characters and figures on the printing paper. The paper carrying the toner image fixed thereon is then folded by and received in a stacker (a paper folding device). If the thermally fixed paper is folded before it is cooled lower than the glass transition point of the toner, the toner is fused at opposing portions of the folded printing paper where characters or figures formed on opposite printing surface portions of the paper are superimposed on each other. Therefore, the toner on one printing surface is peeled off when the printing paper is unfolded. Thus, characters and figures may be sometimes partly removed. This phenomenon is called "toner stick" which may be a serious quality problem in a printer.

In order to prevent such toner stick from occurring, the paper heated in the fixing process can be cooled to lower the paper temperature to a value not higher than the glass transition point of the toner. Although natural cooling or forced cooling by a small-sized fan or blower has been conventionally used to cool printing paper, the paper running speed is so high in printers having a super high printing speed of about 15,000 lines per minute that the time the paper is cooled too short and the paper cannot be sufficiently cooled. One solution is to elongate the paper path system between the fixing device and the stacker and to provide a large-sized fan or blower so as to increase the paper cooling rate. However, these both militate against miniaturization, reduction in power, and reduction in cost of the printer, all of which are desirable.

FIG. 4 shows an example of the paper cooling apparatus according to the prior art described above. Printing paper 1 is heated and fixed by a pre-heater 10 and a heat roll 8 respectively, and forcedly cooled by the cooling air blown from cooling blowers 11. Next, the fixed and cooled paper is folded up by paddles 4, and stacked on a table 6. In the case of a high-speed printer in which the speed of paper passing between the conventional cooling blowers 11 is high, the time during which the paper 1 can receive the cooling air is so short that a sufficient cooling effect cannot be obtained. In order to prevent toner stick from occurring, therefore, it is necessary to provide a large-sized fan or blower corresponding to the paper running speed so that the paper 1 can be cooled sufficiently. In this case, however, the apparatus becomes large in size, and increases in weight, in power consumption, and in manufacturing cost.

SUMMARY OF THE INVENTION

It is therefore an object of the present invention to eliminate the above disadvantages in the prior art.

It is another object of the present invention to provide a paper cooling apparatus which is small in size, which is light in weight, which is inexpensive, which is small in power consumption, and which is high in cooling efficiency.

The present invention achieves these objects by using a cooling fan provided with a duct having a horizontally elongated rectangular outlet opening which is in turn provided on a stacker so as to horizontally send cooling air into the upper portion of the folded-up paper horizontally in the paper width direction. Gaps are thus formed between the sheet portions of the folded-up paper so that the cooling air passes through the gaps and the paper is blown by the cooling air for a long enough time to thereby improve cooling efficiency. Therefore a relatively small-sized fan can be employed.

DETAILED DESCRIPTION OF PREFERRED EMBODIMENT

Figure 1:
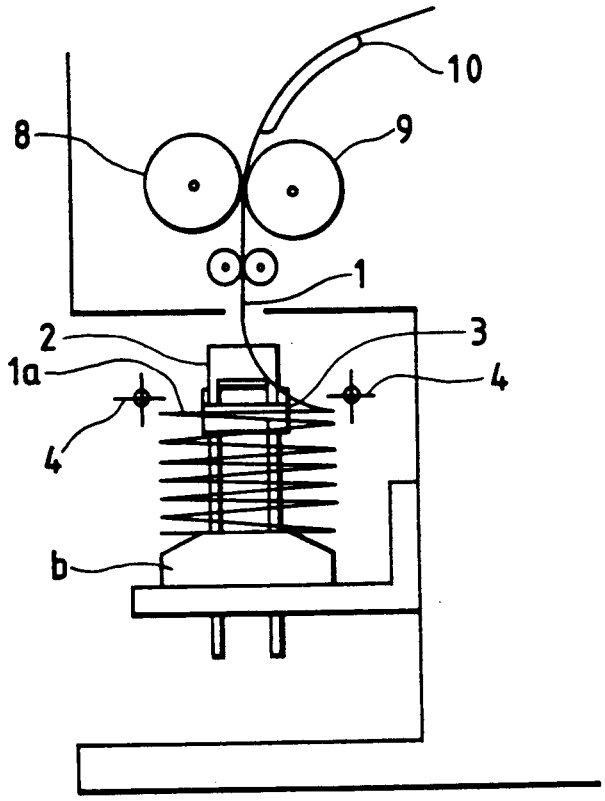
FIG. 1 is a front view of an embodiment of the paper cooling apparatus according to the present invention.
Figure 2:
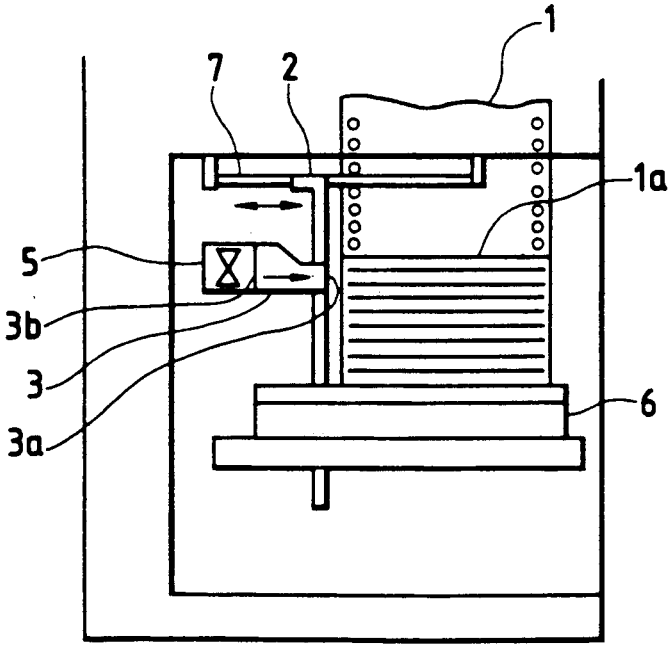
FIG. 2 is a side view of the same.

FIGS. 1 and 2 are views illustrating the whole construction of the paper cooling apparatus as a specific embodiment of the present invention.

A duct 3 having a horizontally elongated rectangular outlet opening portion 3*a* is attached to a paper guide 2 which is slidable to correspond to the width of printing paper 1, at a location slightly under the line connecting the respective rotation centers of paddles 4. A cooling fan 5 is attached to an inlet opening 3*b* on the opposite side to the duct outlet opening 3*a*. The duct outlet opening 3*a* is reduced so as to be narrower than the opposite side opening 3*b*. Cooling air from the cooling fan 5 is blown out through the duct opening 3*a*. Fixed printing paper is folded by the operation of the paddles 4 and stacked on a stacker table 6. When a predetermined quantity of the paper 1 is stacked, the stacker table 6 is lowered so that the level of the folded surface 1*a* of the printing paper is always maintained even to a height slightly under the line connecting the respective rotation centers of the paddles 4.

Figure 3:
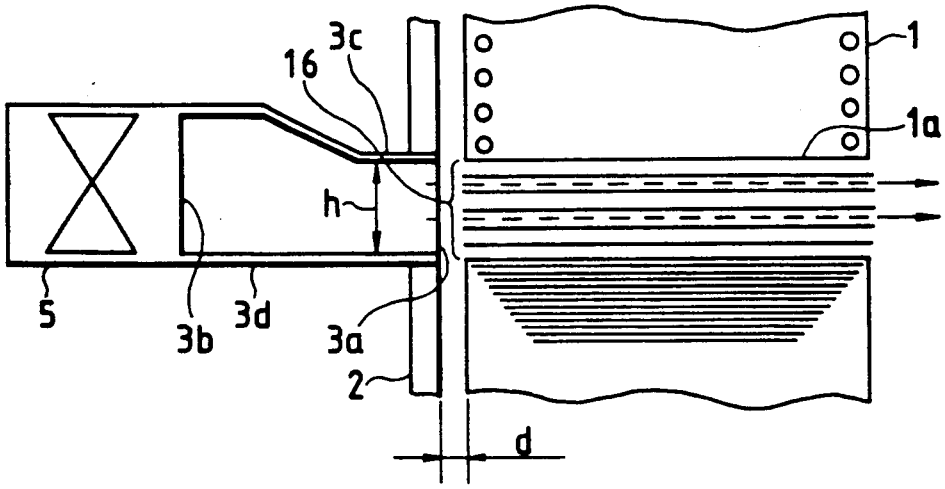
FIG. 3 is an enlarged side view for explaining the operation of the present invention.

The paper cooling operation, in printing, of the thus configured cooling apparatus will be described hereunder. As shown in FIG. 3, the paper folded surface 1*a* in printing is maintained even in level to the upper surface 3*c* of the duct L opening portion 3*a*. Accordingly, paper portion 1*b* opposed to the duct outlet opening portion 3*a* is raised by the air pressure of the cooling air blown out through the duct outlet opening portion 3*a* so that gaps or spaces are formed between pages adjacent to each other. Thus, the paper 1 is cooled by the cooling air blowing into those spaces. This cooling method has advantages as follows.

Figure 4:
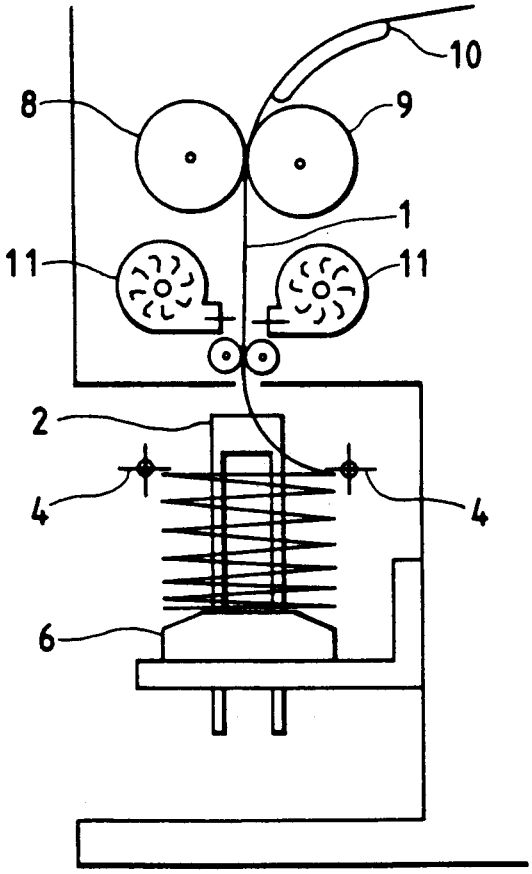
FIG. 4 PRIOR ART
FIG. 4 is a front view showing the prior art of the paper cooling apparatus to be improved by the present invention.

First, the paper 1 is folded up and always receives the cooling air while the paper 1 is passed from the upper surface 3*c* of the duct outlet opening 3*a* to the lower surface 3*d* of the duct outlet opening 3*a* (during the period in which paper is stacked by the height h of the duct outlet opening 3*a*. Accordingly, the cooling time is remarkably prolonged in comparison with the conventional cooling apparatus as shown in FIG. 4 in which the paper can only momentarily receive the cooling air. Moreover, the height of the duct outlet opening 3*a* is less than that of the duct inlet opening 3*b*. Since paper receives the cooling air for a long time, cooling operation having a high cooling effect can be effectively performed even by using a compact and small-output cooling fan.

Further, since the cooling fan 5 and the duct 3 are attached to the paper guide 2 which is slidable corresponding to the width of the printing paper, the distance d between the duct opening portion and paper is definitely determined, and maintained. Accordingly, any kind of paper can be efficiently cooled.

Moreover, since the cooling air is blown only onto a portion of the folded paper, the paper which is being folded is not affected by the air pressure so the folding operation can be stably performed with less occurrences of paper jam on the stacker.

Figure 5:
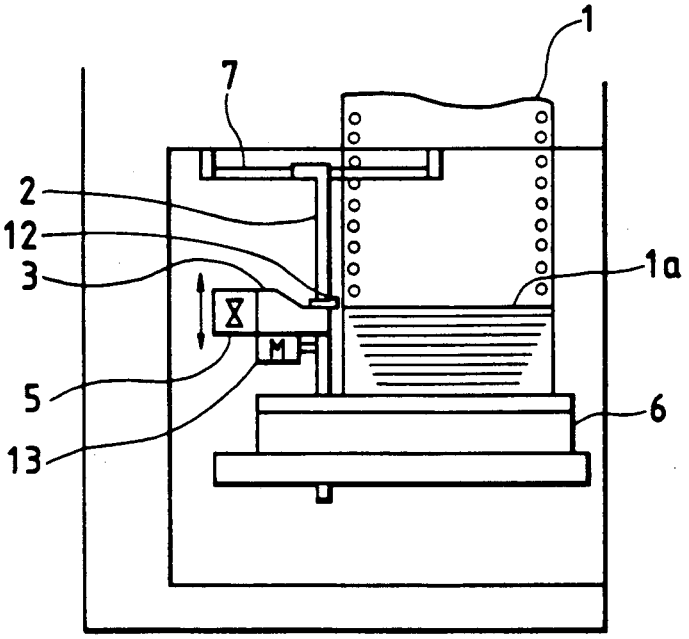
FIG. 5 is a side view showing a modification of the present invention.

Although the above embodiment shows the case where the vertical position of the duct 3 is fixed, the same effect can be obtained in a modification as shown in FIG. 5 in which a sensor 12 for detecting the position of the paper folded surface 1*a* i.e. the top of the stack is attached to the duct 3 so that the duct 3 and the cooling fan 5 are vertically moved along the paper guide 2 by a motor interlocked with the sensor 12 and in response to the output of said sensor.

Although the above embodiment shows the case where the duct 3 and the cooling fan 5 are disposed on the rear side of the printing paper 1 when viewed from an operator side, they may be disposed on the front side of the printing paper 1.

Further, in place of use of the cooling fan 5, cooling air may be introduced from the outside of the stacker by using a duct.

According to the present invention, since even a compact and light cooling apparatus can bring a sufficient cooling effect with no possibility of occurrence of toner stick, it is possible to realize miniaturization and reduction in weight, in cost and in power consumption in a printer.

What is claimed is:

1. A paper stacking and cooling apparatus for an electrophotographic printer in which toner is printed on extending surfaces of paper and fused thereon to form printing comprising:

means for folding the printed fused paper so the printed surfaces are stacked horizontally imbricating the sheets, wherein said folding means includes a paper guide for the folded paper, said guide being slidable horizontally; and means for blowing cooling air between said adjacent folded horizontal surfaces, said blowing means including a duct having a horizontally elongated rectangular outlet opening adjacent the stack of folder paper and an inlet opening and a blower attached to said inlet opening for supplying cooling air thereto, and wherein said duct is mounted to said guide.

2. An apparatus as in claim 1, wherein said folding means includes a stacker table for receiving the folded paper and means to power said table so that the top of the folded stack is maintained at the same height.

3. A paper stacking and cooling apparatus for an electrophotographic printer in which toner is presented on extending surfaces of paper and fused thereon to form printing comprising:

means for folding the printed fused paper so the printed surfaces are stacked horizontally imbricating the sheets, wherein said folding means includes a paper guide for the folded paper; and means for blowing cooling air between said adjacent folded horizontal surfaces, said blowing means including a duct having a horizontally elongated rectangular outlet opening adjacent the stack of folded paper and an inlet opening and a blower attached to said inlet opening for supplying cooling air, and wherein said blowing means further includes means for detecting the position of the top of the folded stack, and means for moving said duct and blower vertically along said paper guide in response to the output of said sensor.

4. A paper cooling apparatus for an electrophotographic printer in which toner is printed on extending surfaces and folded with the extending surfaces extending horizontally and with adjacent surfaces in contact, and said printer having a horizontally slidable paper guide comprising:

means for directing cooling air to the folded paper so that the air passes between said adjacent surfaces to cool the paper and prevent toner stick; and means for mounting said cooling apparatus to said electrophotographic printer, said mounting means including means for mounting to said guide of said printer.

5. A paper cooling apparatus for an electrophotographic printer in which toner is printed on extending surfaces and folded with the extending surfaces extending horizontally and with adjacent surfaces in contact, and said printer having a horizontally slidable paper guide comprising:

means for directing cooling air to the folded paper so that the air passes between said adjacent surfaces to cool the paper and prevent toner stick, wherein said directing means includes a duct having a horizontally elongated rectangular opening adjacent the stack of folded papers and an inlet opening and a blower attached to said inlet opening for supplying cooling air thereto;

means for mounting said cooling apparatus to said electrophotographic printer, said mounting means including means for mounting to said guide of said printer; and means for detecting the position of the top of the folded stack, and means for moving said duct and blower vertically along said slidable guide in response to the output of said sensor.

* * * * *